United States Patent [19]

Geraghty

[11] 4,305,239

[45] Dec. 15, 1981

[54] DEVICE FOR USE IN BUILDING

[76] Inventor: Robin C. Geraghty, 410 ABC Chambers, 66 Field St., Durban, Natal, South Africa

[21] Appl. No.: 21,046

[22] Filed: Mar. 15, 1979

[51] Int. Cl.[3] ..... E04B 1/41; E04C 5/03

[52] U.S. Cl. ..... 52/715; 52/379; 52/713; 52/747

[58] Field of Search ..... 52/379, 378, 713, 715, 52/733, 747, 428, 434, 735; 85/13

[56] References Cited

U.S. PATENT DOCUMENTS

| | | | |
|---|---|---|---|
| Re. 15,221 | 11/1921 | Megenity | 52/379 |
| 386,742 | 7/1888 | Grellner | 85/13 X |
| 616,329 | 12/1898 | Homan | 52/735 |
| 826,042 | 7/1906 | Loveley | 52/735 |
| 836,683 | 11/1906 | Hinchman | 52/733 |
| 1,033,413 | 7/1912 | Kahn | 52/735 X |
| 1,073,931 | 9/1913 | Royse | 52/735 X |
| 1,094,841 | 4/1914 | Ellinger | 52/733 |
| 1,274,953 | 8/1918 | Stoehr | 52/378 |
| 3,172,171 | 3/1965 | Knight | 85/13 |
| 3,261,137 | 7/1966 | Jureit | 85/13 X |
| 3,341,998 | 9/1967 | Lucas | 52/713 X |
| 3,529,918 | 9/1970 | Jureit | 52/715 X |
| 3,955,332 | 5/1976 | Genis | 52/747 |

FOREIGN PATENT DOCUMENTS

| | | | |
|---|---|---|---|
| 22377 | 9/1930 | Australia | 52/735 |
| 574984 | 4/1959 | Canada | 52/428 |
| 19949 | of 1906 | United Kingdom | 52/379 |

*Primary Examiner*—Alfred C. Perham
*Attorney, Agent, or Firm*—Ladas & Parry

[57] ABSTRACT

A device for use in building, particularly for use when bonding bricks in a wall. The device comprises an elongated strip (10) of substantially rigid material forming a main web and having a plurality of flange members (12) projecting therefrom at predetermined distances along the main web. The flange members form, or are capable of forming, substantially a right angle with the main web. The flange members may project from one or both sides of the main web, and may be joined by wires to flange members of an adjacent device.

2 Claims, 16 Drawing Figures

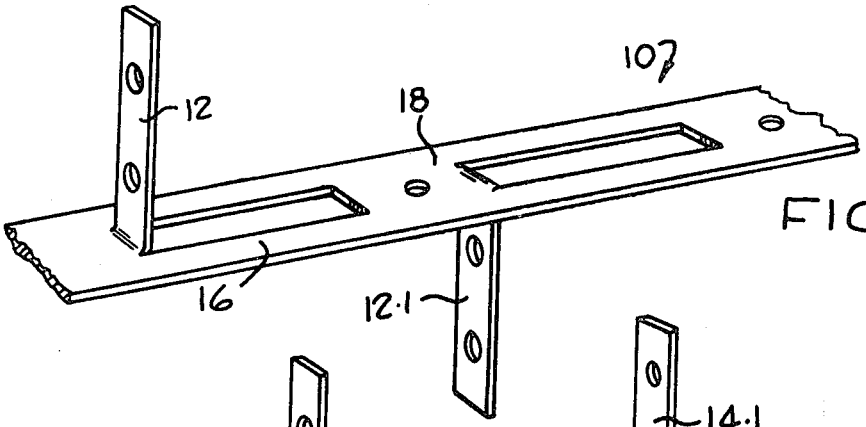
FIG. 1.a
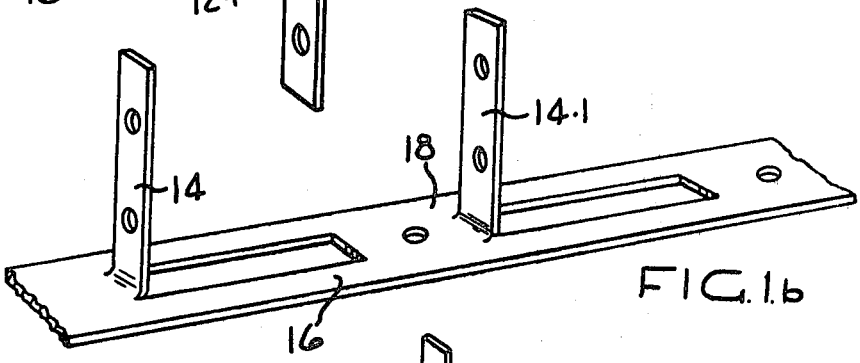
FIG. 1.b
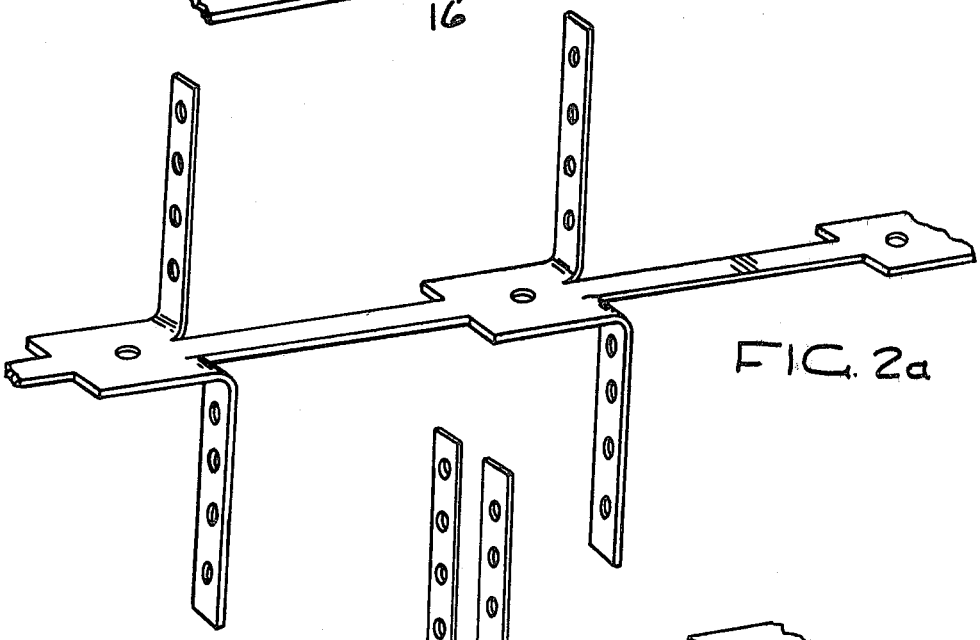
FIG. 2a
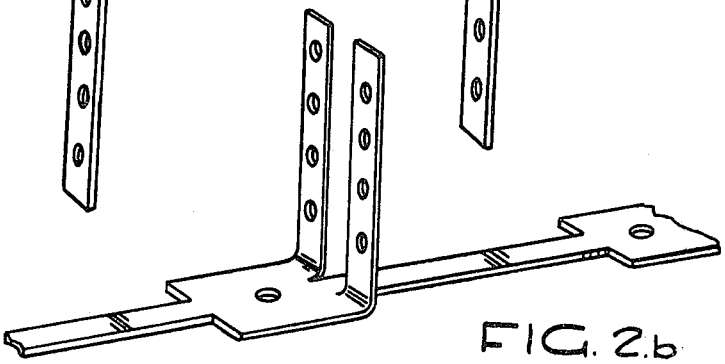
FIG. 2.b

DEVICE FOR USE IN BUILDING

This invention relates to a device for use in building.

The present invention provides a device for use in building comprising an elongated strip of substantially rigid material forming a main web and having a plurality of flange members projecting therefrom at predetermined distances along the web, the flange members forming or being capable of forming substantially a right angle with the main web.

Conveniently, the strip is of a suitable metal, for example a malleable or bendable material such as galvanised iron, steel, mild steel, or the like. The flange members and web may both be formed from an elongated strip of the iron or similar material. This may be effected by forming a plurality of longitudinal cuts along the length of the material with lateral cuts across the one end of each longitudinal cut to define a plurality of tongues in the main web, the tongues being capable of being bent substantially at right angles to the main web to form the flange members.

Alternatively, the flange members may be formed from a separate length of the same or a different material. Thus the flange members may be of metal strip, wire or the like. The width of the flange members can be smaller than, the same as, or greater than that of the main web. Separate flanges can be welded, bolted or rivetted to the main web.

The flange members may be flat sided or crimped. They may have holes therein and/or may have a jagged or saw tooth profile.

Whether the flange members are formed from the same strip of material or not, the device provided by the invention may be supplied with the flange members not bent away from the main web, but capable of being bent substantially at right angles to the main web in use.

In a first embodiment the device may have a continuous central web with flanges on one or both sides thereof. In this embodiment longitudinal cuts can be made in the strip with lateral cuts extending from the outside edges of the web to one end of each longitudinal cut to define tongues which can be bent to form the flange members. In this embodiment, the lateral cuts may be so spaced that shoulders of a width substantially equal to the width of the strip are formed at predetermined spaced-apart distances along the strip. The flange members may be of substantially equal width or of different widths.

Alternatively, in a second embodiment, the web may surround a plurality of central flanges formed therein. In this embodiment the lateral cuts are central cuts across the ends of the tongues. There may be two flanges extending from a particular shoulder, or there may only be a single flange. The single flange may be formed centrally of the strip by forming pairs of spaced-apart cuts longitudinally along the strip with lateral cuts joining an end of each longitudinal cut. In this way, the flange can be centrally positioned by bending the tongue, so formed, upwardly or downwardly from the main web to provide the flange.

In a third embodiment the main web may extend continuously along one side of the strip, with a plurality of flange members adjacent to each other across the remainder of the width of strip.

Should it be desired, not all of the flange members need be of the same width or same length. They need not all be of the same shape.

Instead of forming the flange members from the same strip of material as the main web, they may be formed from a separate strip of material, wire or the like, and attached to one or both sides of the main web. When formed from a separate strip of material, the flange members can extend across the complete width of the strip forming the main web. The device provided by the invention may be treated to reduce or avoid rusting.

In any embodiment, the web and/or the flange members may have apertures formed therein. These apertures can be in the form of circular holes. The holes may be formed by drilling. The holes can be of use in holding the device in position in a building. For example, wet cement or mortar can set hard therein.

The flange members may extend in opposite directions (so that two flanges are at 180 degrees to each other) from the main web or may extend in the same direction from the main web (so that both flanges extend to one side of the main web). Alternatively, a web may be provided with flanges extending in both directions. If desired, the flanges may be bent in situ to the desired position.

The material used for making the device conveniently is iron but other suitable materials, such as other metals or substantially rigid plastics materials may be used. The device provided by the invention may be manufactured on suitable metal working machines if a metal is used.

In any embodiment, the distance between adjacent flanges along the length of the strip may be substantially equal to the distance between the top of a number of adjacent layers, eg four layers, of bricks or blocks of standard size in a wall.

Alternatively, the distance between adjacent flanges may be substantially equal to the distance between a number of adjacent bricks in a horizontal position on a wall.

The holes in the web and flanges permit mortar to be received by the device and thereby hold the device rigidly to the bricks. It therefore becomes more difficult for a brick accidentally to be displaced from its intended position once the wall has been built.

The device provided by the invention may, alternatively be positioned so as to be cast in a concrete column, wall, door or window surround, or the like, or fitted in any other desired surface.

If desired, a plurality of substantially parallel devices provided by the invention may be positioned in a casting, or surface fixed into concrete with the flanges extending outwardly at such positions that there are flanges facing in each other at substantially the same height. In this embodiment, the flanges can be used as a basis for providing levels for courses of brickwork. Conveniently, spaced apart concrete columns can have a pair of flanges extending outwardly along the intended lines of the course of brickwork so that there are two parallel flanges from one column facing two parallel flanges from the adjacent column. The flanges can be connected by wire. If desired, galvanised or other ties may join the two spaced apart lengths of wire after a course of bricks has been laid. Conveniently preformed ladder-like units may be made from the wire and ties. The ladder-like units may be in sections which can be linked together. The mortar on top of that course of bricks will then bond the lengths of wire and ties into the wall. This can be of great advantage in a high rise building since it reduces the possibility of a large number of bricks accidentally being displaced.

In the embodiment using wires between adjacent flanges, the ends of the wires can be hooked in holes in the flanges. The cross ties may be spot-welded or crimped around the wires. The ties may be of predetermined length and may have a downwardly extending valley towards the centre thereof. In this embodiment, the downwardly-extending valley may be positioned between two adjacent rows of brickwork with the wires within the walls of the brickwork. Furthermore, the spacing of the flanges may be such that they do not extend along every course of brickwork but after every fourth or fifth course.

The invention is illustrated by reference to the accompanying drawing in which:

FIGS 1*a* and 1*b* are three dimensional views of one embodiment of the invention;

FIGS. 2*a* and 2*b* are three dimensional views of a second embodiment of the invention;

In FIGS. 1*a* and 1*b*, a strip 10 of iron is cut to form a plurality of tongues which are bent to provide flange members 12, 12.1 in opposite directions or 14, 14.1 in the same direction. The tongues are surrounded by a web 16. Between adjacent tongues are shoulders 18. Holes are drilled in the shoulders 18 and in the tongues before the tongues are formed into the protruding flange members 12, 12.1.

Figure 3:
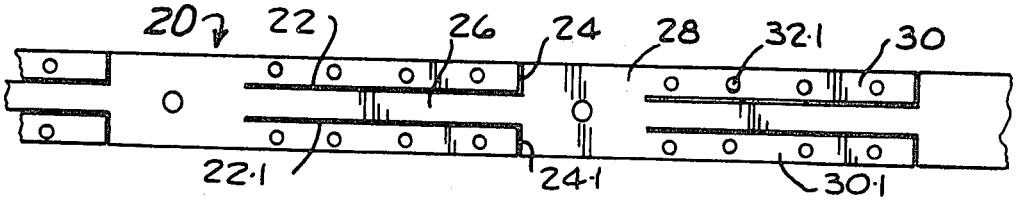
FIG. 3 is a plan view of the second embodiment before forming the flanges.

In FIGS. 2*a*, 2*b* and 3, a strip of iron 20 has a plurality of longitudinally extending cuts 22, 22.1 and laterally extending cuts 24, 24.1 formed in it to define a central web 26 having a plurality of shoulders 28 at spaced apart distances along it.

Flange members 30, 30.1 so formed are bent in the same direction (FIG. 2*b*) or opposite directions (FIG. 2*a*) to form the device provided by the invention. Before bending the flanges, the flange members and the web have holes 32, 32.1 etc formed in them.

Figure 4:
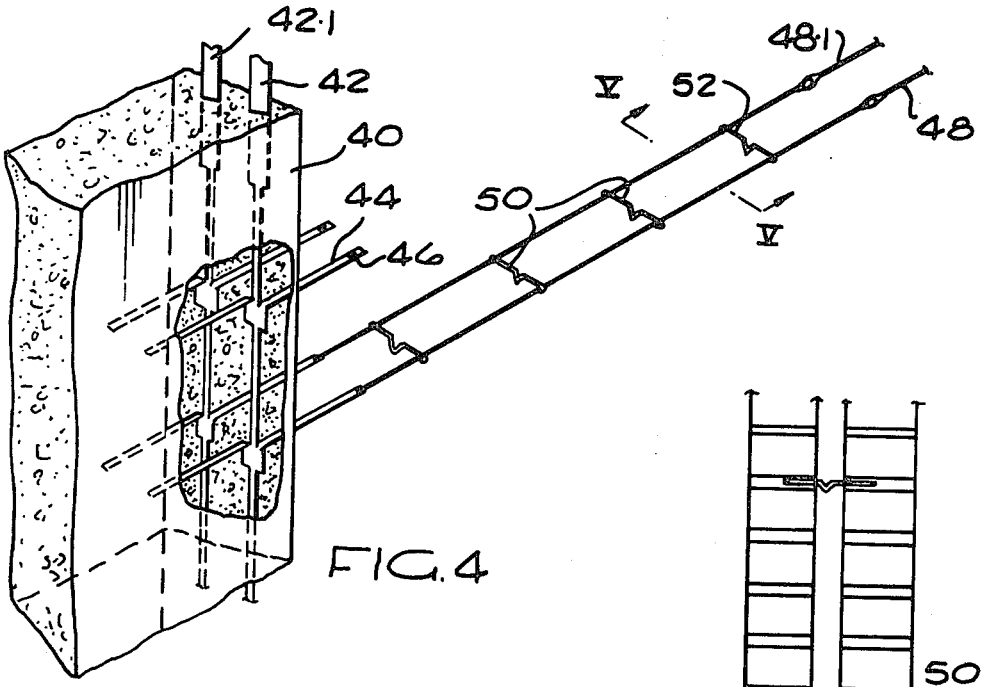
FIG. 4 illustrates, in three dimensions, a use of the second embodiment of the invention.

Referring to FIG. 4, a concrete pillar 40, has two devices 42, 42.1 cast in it. The devices have outwardly extending flanges 44 containing holes 46 etc. These flange members face corresponding flange members in another concrete piller (not shown). Wires 48, 48.1 are provided between the holes 46 of the flanges at the same level. A plurality of galvanised ties 50 having central valleys 52 are spot-welded or crimped to the bond wires 48, 48.1 at predetermined distances along those wires.

Figure 6:
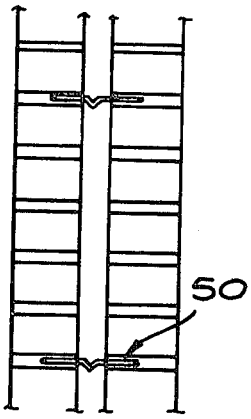
FIG. 6 is a cross section through a wall built with the embodiment of FIG. 4.
Figure 5:
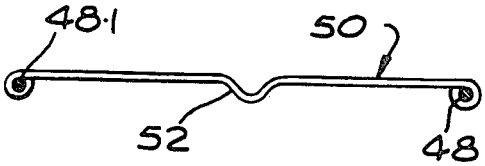
FIG. 5 is a section along V—V of FIG. 4.

As can be seen from FIG. 6, the device provided by the invention may have flanges and bond wires at every fifth course instead of every single course.

Figure 7:
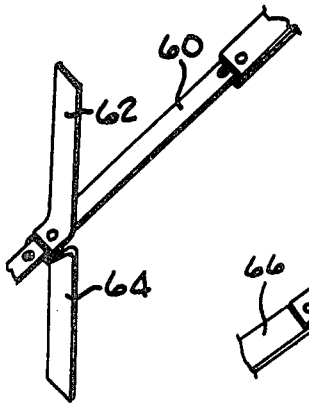
FIGS. 7 to 14 illustrate further embodiments of the invention.

In FIG. 7, the device according to the invention comprises a main web 60 with flange members 62 and 64 extending from opposite sides thereof. The flange members 62, 64 are rivetted to the main web 60.

Figure 8:
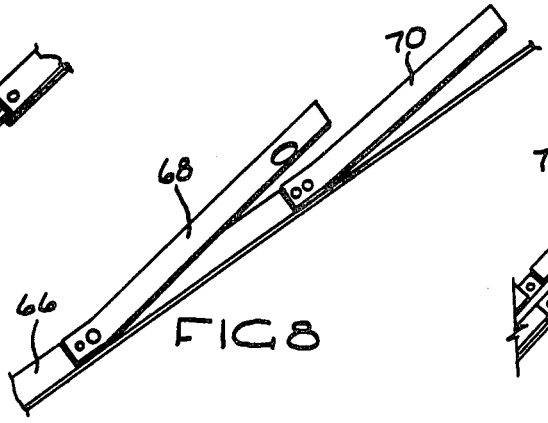

In FIG. 8, a main web 66 has flange members 68, 70 extending from one side thereof. In the embodiment shown, the flange members have not yet been fully bent out to form a right angle with the main web 66. The flange members 68, 70 are bolted to the main web 66 and are of such a length that they overlap each other until fully bent out to 90 degrees.

Figure 9:
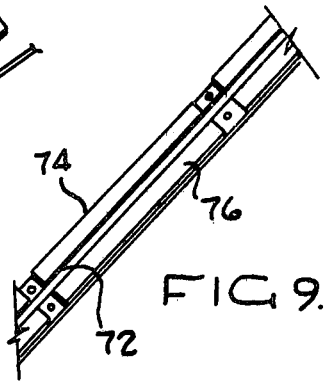
Figure 10:
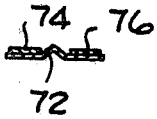

In FIGS. 9 and 10, a main web 72 has flange members 74, 76 etc bolted to it. The main web is not planar but is of the shape shown in cross section in FIG. 10.

Figure 11:
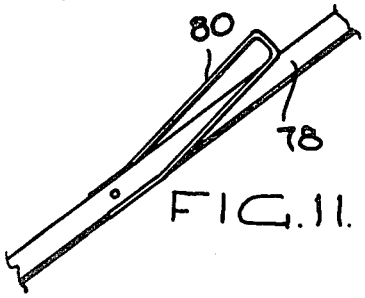

In FIG. 11, a main web 78 has wire flange member 80 welded along its edges.

Figure 12:
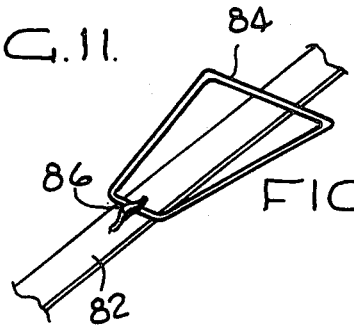

In FIG. 12 a main web 82 has a wire flange 84 fitted beneath a lug 86 formed from the main web.

Figure 13:
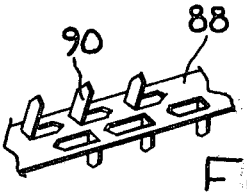

In FIG. 13, a main web 88 has a plurality of pointed flanges 90 formed therefrom.

Figure 14:
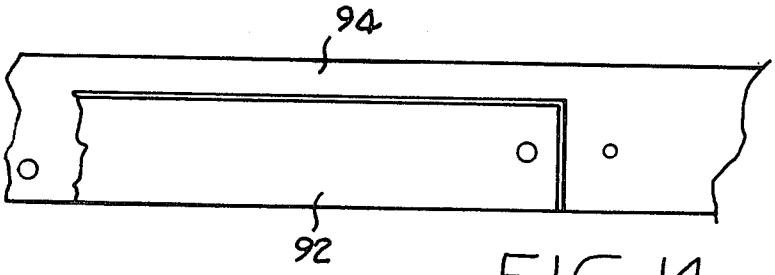

FIG. 14 illustrates an example of the device provided by the invention when the flange members are formed from the main web but before the flange members have been bent outwardly at 90 degrees. As can be seen from this particular illustration, the flange member 92 is of greater width than the main web 94.

The bond wires may merely be hooked into the holes in the flanges of the device, or may be more permanently attached.

The device provided by the invention is particularly suitable for bonding brickwork and mortar to other adjoining materials. Not only is brickwork bonded by mortar to such adjoining materials but wire ties are provided between the bricks and adjacent structural parts. This has the advantage that a building supervisor easily can see that the device is being used. The device could eradicate or reduce the possibility of displaced brickwork, especially in high rise buildings, thereby it is hoped eradicating fatal accidents due to displaced brickwork.

The device provided by the invention is inexpensive to manufacture.

I claim:

1. A device for use in building, said device comprising a main web in the form of a substantially rigid strip of metal or plastics material having a pair of opposite side faces joined by a pair of opposite edges, and a pair of flange members formed on site to project from the side faces of the main web at predetermind distances along the main web, the positioning of the flange members complying with the following criteria:

(i) said flange members comprise a plurality of first flange members formed on site to project from one side face and second flange members formed on site to project from the other side face of the web, (ii) each flange member is perforated with holes and is formed on site to be substantially at right angles to the web whereby the first and second flange members are formed on site to be substantially in planes at 180° to each other, and (iii) at a predetermined distance along the web where a flange member is formed on site to project from the web, there is both a first flange member formed on site to project in one direction and a second flange member formed on site to project in the other direction.

2. A method of building, which comprises the steps of (i) providing a plurality of devices comprising blanks having a main web in the form of a substantially rigid strip of metal or plastics material having a pair of opposite side faces joined by a pair of opposite edges a plurality of spaced-apart pairs of longitudinal cuts formed through said side faces at predetermined spaced-apart positions along the length of the web, and a plurality of lateral cuts extending from each edge of the main web to one end of the longitudinally extending cuts to form a plurality of first and second flange members from the web, each said first and second flange member being attached to the remainder of the main web at one end only, the point of attachment of a first flange member on one side of the central longitudinal axis of the main web being substantially in line with the point of attachment of the second flange member on the opposite side of the central longitudinal axis of the web, (ii) positioning said devices at spaced-apart distances from each other with the said main webs substantially vertical, (iii) bending the flange members on site so that the flange members project from the side faces of the main web at predetermined distances along the main web, the positioning of the flange members, after the said bending, complying with the following criteria:

(a) said flange members comprise a plurality of first flange members projecting from one side face and second flange members projecting from the other side face of the web.

(b) each flange member is perforated with holes and, after bending, is substantially at right angles to the web whereby the first and second flange members, after bending, are substantially in planes at 180° to each other, and (c) at a predetermined distance along the web where a flange member has been bent to project from the web, there is both a first flange member projecting in one direction and a second flange member projecting in the other direction (iv) before or after bending the said flange holding the said devices with the main web substantially vertical, (v) while holding the said devices with the main web substantially vertical casting concrete in the form of substantially vertical columns around the webs to leave the flanges projecting outwardly from the sides of the columns in a substantially horizontal direction and (vi) allowing the concrete to set.

* * * * *